United States Patent [19]

Pflieger et al.

[11] 4,038,109

[45] July 26, 1977

[54] THREE PHASE HEAT TREATMENT OF STEEL SHEET

[75] Inventors: Bernard Pflieger, Chamalieres; André Reiniche, Ceyrat, both of France

[73] Assignee: Compagnie Generale des Etablissements Michelin, France

[21] Appl. No.: 688,112

[22] Filed: May 20, 1976

[30] Foreign Application Priority Data

May 21, 1975 France ..... 75.15899

[51] Int. Cl.[2] ..... C21D 7/14; C21D 1/78; C23C 11/12; C23C 11/18

[52] U.S. Cl. ..... 148/12 F; 148/16.5; 148/16.6; 148/134

[58] Field of Search ..... 148/12 F, 16.5, 16.6, 148/134

[56] References Cited

U.S. PATENT DOCUMENTS

| | | | |
|---|---|---|---|
| 3,891,474 | 6/1975 | Grange | 148/16.5 |
| 3,936,324 | 2/1976 | Uchida et al. | 148/12 F |

*Primary Examiner*—Arthur J. Steiner
*Attorney, Agent, or Firm*—Brumbaugh, Graves, Donohue & Raymond

[57] ABSTRACT

A medium-hard to hard thin steel sheet and a strip cut or stamped therefrom, both having an increased fatigue strength, are prepared by cold rolling a soft steel sheet, carburizing or carbo-nitriding the soft thinned sheet until a medium-hard to hard thin steel sheet is obtained and subjecting the resulting sheet or strip cut or stamped therefrom to a three-part heat treatment, which heat treatment involves first and second different austenizing operations, each followed by an identical two-step cooling operation, and a third lesser reheating and cooling operation.

6 Claims, 1 Drawing Figure

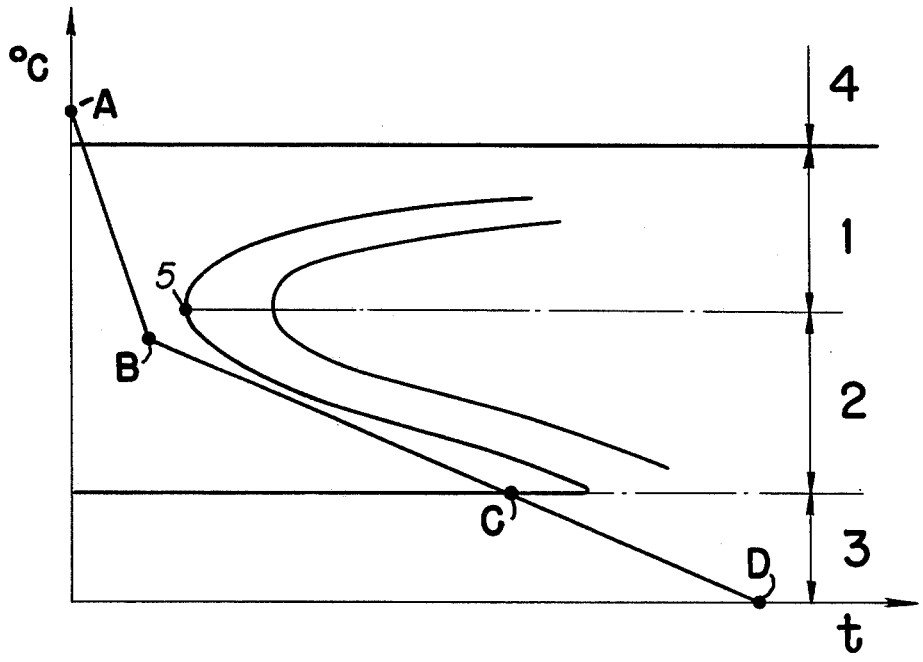
°C
A
4
1
5
B
2
C
3
D
t

THREE PHASE HEAT TREATMENT OF STEEL SHEET

The present invention relates to improvements in steel sheets and to articles made from such sheets. More particularly, it concerns medium-hard to hard thin steel sheets of a thickness of between about 10 μm and about 500 μm. The expression medium-hard to hard steel designates steel having a carbon content of between about 0.5% and about 1.2% by weight. This is by way of contradistinction to soft steel whose carbon content is less than about 0.25% by weight.

It is known that medium-hard to hard thin steel sheets of a carbon content of between about 0.5% and about 1.2% by weight can be obtained by cold rolling a soft steel sheet having a carbon content of less than about 0.25% by weight until the desired thickness is obtained, and then subjecting the sheet, which has been thinned in this manner, to a carburizing or carbo-nitriding treatment until the desired higher carbon content is obtained.

By this known process, the number of cold rolling passes and the number of intermediate heat treatments are reduced, while substantially increasing the rolling width of the sheet on a rolling mill of the Sendzimir type. Furthermore, the sheet is carburized or carbo-nitrided throughout. In this way, the production of burrs upon the cutting of such sheets is avoided, which burrs might constitute the starting points of tears on the edges of the articles produced by cutting when these articles are subjected to repeated dynamic stresses.

A medium-hard to hard thin steel sheet manufactured by this known process, that is to say from cold rolling a thicker sheet of effervescent or dead soft steel followed by carburizing or carbo-nitriding the thus thinned sheet, is easily distinguished from a medium-hard to hard thin steel sheet obtained by simply cold rolling a thicker sheet of medium-hard to hard steel in the following manner. In the case of a thin sheet manufactured by this known process, the product of the carbon weight content (C%) multiplied by the total oxygen weight content (0%) is a high value between about $2 \times 10^{-3}$ and about $120 \times 10^{-3}$. In the case of a thin sheet obtained, on the other hand, by cold rolling a sheet of medium-hard to hard steel [carbon weight content (C%) between about 0.5% and about 1.2%], this same product (C% × 0%) may vary between a lower value of about $1 \times 10^{-3}$ and about $2 \times 10^{-3}$ (See, for instance, Colombier, Metallurgie du Fer, Dunod 1957, page 68).

As a matter of fact, in the case of a sheet made in accordance with this known process, the total oxygen weight content (0%) is not modified by the carburizing or carbo-nitriding operation, while this latter operation considerably increases the carbon weight content (C%). Therefore, elementary chemical analysis makes it possible to readily distinguish a medium-hard to hard thin steel sheet produced from an originally soft steel in accordance with this known process from another medium-hard to hard thin steel sheet produced from an originally medium-hard to hard steel.

However, certain articles produced from thin sheets manufactured in accordance with this known process, for instance, springs or reinforcement elements for articles of vulcanized rubber, are subjected to repeated extensive deformations and exhibit insufficient fatique strength. For this reason, the object of the present invention is to increase the fatique strength of these articles by an additional heat treatment. This additional heat treatment pursuant to the present invention can be applied to the thin sheet itself or to the articles themselves which have been produced from this thin sheet. This additional heat treatment comprises three parts and is characterized as follows.

The first part consists of:

a first austenizing operation at an elevated temperature for a sufficient period of time to obtain a very homogeneous austenitic steel, followed by a two-step cooling.

The second part consists of:

a second austenizing operation of very short duration at a temperature very slightly above the transformation point from the α phase to the γ phase, followed by a two-step cooling identical to that of the first part.

This two-step cooling or quenching comprises a first rapid cooling step which terminates in the vicinity of the temperature separating the pearlitic zone from the bainitic zone, and then a second slow cooling step from the above temperature down to ambient temperature, the rates of cooling being selected in such a manner as to pass around the pearlitic "nose" in the TTT (temperature, time, texture) diagram corresponding to the chemical composition of the medium-hard to hard thin steel sheet produced in accordance with the invention. A martensitic structure which is free of pearlite and or bainite is then obtained. The two austenizing operations and at least each of the first cooling steps are carried out in an oxygen-free medium.

After passing the boundary between the bainitic zone and the martensitic zone, the cooling can be allowed to continue slowly in ambient air.

The third part of the additional heat treatment consists of:

a rapid reheating operation to a temperature above about 300° C. in an oxygen-free medium, followed by a final cooling in ambient air.

The additional heat treatment defined above makes it possible to obtain a grain fineness which is unusual in steels which are free of a grain-refining element, such as aluminum.

This additional heat treatment thus makes it possible to obtain products which are free of cooling or quenching cracks and exceed, at rupture, a relative elongation of about 4.8% and a tensile stress of about 250 kg./mm$^2$. It goes without saying that this additional heat treatment does not modify the product C% × 0% which is characteristic of the thin sheets used and the production of which has been described above.

The first austenizing operation of the first part of this additional heat treatment is preferably carried out at a temperature of between about 900° C. and about 1000° C.; the second austenizing operation of the second part of this additional heat treatment is preferably carried out at a temperature of between about 750° C. and about 850° C.; and the reheating operation of the third part of this additional heat treatment is preferably carried out at a temperature of between about 300° C. and about 400° C.

If it is desired to obtain articles in the form of continuous strips, such as springs or reinforcing elements for articles of vulcanized rubber, it is advantagoues, first of all, to cut the thin sheet not treated in accordance with the present invention into strips and then subject the strips thus obtained to the above-indicated additional heat treatment. This avoids rapid wear of the cutting tools. The said additional heat treatment then attenuates the stresses and deformations due to the cutting of the thin sheet into strips, this resulting in an improvement in the fatique strength.

The embodiments which are described below are intended to assure a better understanding of the invention. However, these examples in no way limit the invention.

Sheets of a thickness of 2 mm. of soft steels having the following compositions (in % by weight) were cold rolled in succession on a Sendzimir rolling mill to a thickness of 100 μm.

| | | | |
|---|---|---|---|
| Sheet A1) | C = 0.25 | Mn = 0.75 | Si = 0.07 |
| | S = 0.02 | P = 0.02 | Ni = 0.03 |
| | Cr = 0.06 | N = 0.003 | 0 (total) = 0.005 |
| Sheet A2) | C = 0.028 | Mn = 0.19 | Si = 0.05 |
| | S = 0.022 | P = 0.025 | Ni = 0.03 |
| | Cr = 0.05 | Cu = 0.006 | N = 0.003 |
| | | | 0 total) = 0.069 |
| Sheet A3) | C = 0.085 | Mn = 0.3 | S = 0.024 |
| | P = 0.024 | Ni = 0.025 | Cr = 0.05 |
| | Cu = 0.056 | N = 0.003 | 0 (total) = 0.0145 |

For a thickness tolerance of ± 2 μm, the rolling width was 80 cm.

Sheets A1, A2 and A3 were carburized by continuous passage through a furnace at a temperature of about 970° C. The carburization gas had the following composition:

85% by volume hydrogen
15% by volume of a mixture of (% by volume)
88% methane
6.5% ethane
1% propane
4.5% nitrogen and traces of other gaseous hydrocarbons.

The condensation point of carburization gas upon its entrance into the furnace was −60° C.

The final carbon weight contents (C%) were:
0.5% for sheet A1,
1.2% for sheet A2, and
0.8% for sheet A3.
These contents were obtained by varying the pass times of said sheets in the furnace.

The products, C% × 0%, characteristic of these thin sheets thus produced were:
$2.5 \times 10^{-3}$ for sheet Al,
$83 \times 10^{-3}$ for sheet A2, and
$11.6 \times 10^{-3}$ for sheet A3.

After carburization, sheet A3 had a rupture strength of 110 kg/mm². This sheet was thereafter cut parallel to the direction of cold rolling into strips of a width of 4 mm., being careful to eliminate the over-carburized edges of the thin sheet.

Thereupon the strips were subjected to the additional heat treatment in accordance with the invention.

The first part of this additional heat treatment entailed a first austenizing operation in a bed of alumina or zirconia particles fluidized with argon or nitrogen, at a temperature of 1000° C.; the time of passage through the fluidized bed was 3 seconds; and the holding time at a temperature above the austenizing temperature was about 2 seconds.

As can be noted from the accompanying TTT diagram, the first rapid cooling step AB carried out in an oxygen-free medium lasts for about 0.3 seconds and stops at B, at a temperature slightly below the boundary between the pearlitic zone 1 and the bainitic zone 2, the pearlitic "nose" being indicated by the point 5. The second slow cooling step BC is obtained by passage through pulsated air. It continues in the martensitic zone 3 to the point D in ambient air. The stable austenite zone is designated by 4. The entire second slow cooling step BCD takes about 3 seconds.

The second part of this additional heat treatment entailed a second austenizing operation in a bed of alumina or zirconia particles fluidized with argon or nitrogen at a temperature of 800° C., followed by a two-step cooling identical to that used in the first part of this treatment and, like the latter, passing around the pearlitic "nose" 5. The time of passage through the fluidized bed at 800° C. was 3 seconds and the holding time at a temperature above the austenizing temperature was about 0.4 seconds.

The third part of this additional heat treatment consisted of a rapid reheating operation to 350° C. in a bed of alumina or zirconia particles, fluidized with argon or nitrogen, followed by rapid return to ambient temperature. The time of passage through the fluidized bed at 350° C. was 3 seconds.

In this way there is obtained a very fine grained strip free of quenching cracks and having, at rupture, a relative elongation of 5.2% and a tensile stress of 262 kg./mm².

What is claimed is:

1. A process for manufacturing a medium-hard to hard thin steel sheet having an increased fatigue strength in which a soft steel sheet having a carbon weight content of less than about 0.25% is cold rolled to a thickness of between about 10 μm and about 500 μm whereupon the resulting soft thin steel sheet is subjected to a carburizing or carbonitriding treatment until a medium-hard to hard thin steel sheet having a carbon weight content of between about 0.5% and about 1.2% is obtained, characterized by the fact that the carburizing or carbo-nitriding treatment is followed by a three-part heat treatment, the first part of which heat treatment consists of a first austenizing operation at an elevated temperature for a sufficient period of time to obtain a very homogeneous austenitic steel, followed by a two-step cooling; the second part of which heat treatment consists of a second austenizing operation of very short duration at a temperature very slightly above the transformation point from the α phase to the γ phase, followed by a two-step cooling identical to that following the first part of the three-part heat treatment, this two-step cooling comprising a first rapid cooling step which terminates in the vicinity of the temperature separating the pearlitic zone from the bainitic zone and a second slow cooling step from the above temperature down to ambient temperature, the rates of cooling being selected in such a manner as to pass around the pearlitic nose in the T T T (temperature, time, texture) diagram corresponding to the chemical composition of the medium-hard to hard thin steel sheet and so as to obtain a martensitic structure free of pearlite and bainite, the two austenizing operations and each of the first cooling steps being carried out in an oxygen-free medium; and the third part of which heat treatment consists of a rapid reheating operation to a temperature above about 300° C. in an oxygen-free medium, followed by a final cooling in ambient air.

2. The process according to claim 1, characterized by the fact that the first austenizing operation is carried out at a temperature of between about 900° C. and about 1000° C., the second austenizing operation is carried out at a temperature of between about 750° C. and about 850° C., and the reheating operation is carried out at a temperature of between about 300° C. and about 400° C.

3. The process according to claim 1, characterized by the fact that the oxygen-free media of the two austenizing operations and of the reheating operation are beds of alumina or zirconia particles fluidized with argon or nitrogen.

4. The process according to claim 1, characterized by the fact that the medium-hard to hard thin steel sheet is cut or stamped into strips before the three-part heat treatment.

5. A medium-hard to hard thin steel sheet manufactured in accordance with claim 1 having a product of the carbon weight content (C%) multiplied by the total oxygen weight content (0%) of the sheet of between about $2 \times 10^{-3}$ and about $120 \times 10^{-3}$, characterized by the fact that, at rupture, the relative elongation is greater than about 4.8% and the tensile stress is greater than about 250 kg./mm$^2$.

6. A medium-hard to hard thin steel strip manufactured in accordance with claim 4 having a product of the carbon weight content (C%) multiplied by the total oxygen weight content (0%) of the strip of between about $2 \times 10^{-3}$ and about $120 \times 10^{-3}$, characterized by the fact that, at rupture, the relative elongation is greater than about 4.8% and the tensile stress is greater than about 250 kg./mm$^2$.

* * * * *